US007152822B2

(12) United States Patent
Evertsson

(10) Patent No.: US 7,152,822 B2
(45) Date of Patent: Dec. 26, 2006

(54) WEAR PART FOR GYRATORY CRUSHER AND METHOD OF MANUFACTURING THE SAME

(75) Inventor: Magnus Evertsson, Askim (SE)

(73) Assignee: Sandvik Intellectual Property AB, Sandviken (SE)

( * ) Notice: Subject to any disclaimer, the term of this patent is extended or adjusted under 35 U.S.C. 154(b) by 45 days.

(21) Appl. No.: 10/982,761

(22) Filed: Nov. 8, 2004

(65) Prior Publication Data

US 2005/0133647 A1 Jun. 23, 2005

(30) Foreign Application Priority Data

Nov. 12, 2003 (SE) ..... 0302974

(51) Int. Cl.
*B02C 2/00* (2006.01)

(52) U.S. Cl. ..... 241/207

(58) Field of Classification Search ..... 241/207–216
See application file for complete search history.

(56) References Cited

U.S. PATENT DOCUMENTS 1,894,601 A 1/1933 Symons
2,970,783 A 2/1961 Cheyette
4,566,638 A 1/1986 Lundin et al.
6,123,279 A 9/2000 Stafford et al.

FOREIGN PATENT DOCUMENTS

WO WO 93/14870 8/1993
WO WO 03/099443 12/2003

*Primary Examiner*—Mark Rosenbaum
(74) *Attorney, Agent, or Firm*—Drinker Biddle & Reath LLP

(57) ABSTRACT

A gyratory crusher includes a first shell having a support surface intended to abut against a shell-carrying member, and a first crushing surface intended to be brought into contact with material fed into the upper portion of the crusher, to crush the material against a corresponding second crushing surface disposed on a second shell arranged opposite the first shell. The first and second crushing surfaces oppose one another in spaced relationship to form a gap through which the material travels as it is being crushed. The gap includes an upper inlet and a lower outlet. Over at least 50% of the vertical height, from the outlet upwards toward the inlet, the first crushing surface is machined to a run-out tolerance, which on each level along the machined part of the vertical height does not exceed one thousandth of the largest diameter of the first crushing surface, or 0.5 mm, whichever is less.

8 Claims, 7 Drawing Sheets

III

WEAR PART FOR GYRATORY CRUSHER AND METHOD OF MANUFACTURING THE SAME

The present application claims priority under 35 U.S.C. § 119 to patent application Ser. No. 0302974-1 filed in Sweden on Nov. 12, 2004, the content of which is hereby incorporated by reference.

TECHNICAL FIELD OF THE INVENTION

The present invention relates to a shell for use in a gyratory crusher, which shell has at least one support surface, which is intended to abut against a shell-carrying member, and a first crushing surface, which is intended to be brought into contact with a material that is supplied at the upper portion of the crusher and is to be crushed, and to crush said material in a crushing gap against a corresponding second crushing surface on a second shell complementary with the shell.

The present invention also relates to a method of producing a shell for use in a gyratory crusher, which shell is of the above-mentioned kind.

The invention also relates to a gyratory crusher, which, on one hand, has a first shell, which has at least one support surface, which is intended to abut against a first shell-carrying member, and a first crushing surface, and on the other hand a second shell, which has at least one support surface, which is intended to abut against a second shell-carrying member, and a second crushing surface, the first crushing surface and the second crushing surface being arranged to be brought into contact with a material supplied at the upper portion of the crusher, which material is to be crushed in a crushing gap between the crushing surfaces.

BACKGROUND ART

Upon fine crushing of hard material, e.g. stone blocks or ore blocks, material is crushed that has an initial size of approx. 100 mm or less to a size of typically approx. 0–25 mm. Fine crushing is frequently carried out by means of a gyratory crusher. An example of a gyratory crusher is disclosed in U.S. Pat. No. 4,566,638. Said crusher has an outer shell that is mounted in a stand. An inner shell is fastened on a crushing head. The inner and outer shells are usually cast in manganese steel, which is strain hardening, i.e., the steel gets an increased hardness when it is exposed to mechanical action. The crushing head is fastened on a shaft, which at the lower end thereof is eccentrically mounted and which is driven by a motor. Between the outer and the inner shell, a crushing gap is formed into which material can be supplied. Upon crushing, the motor will get the shaft and thereby the crushing head to execute a gyratory pendulum motion, i.e., a motion during which the inner and the outer shell approach each other along a rotary generatrix and retreat from each other along another diametrically opposite generatrix.

WO 93/14870 discloses a method to set the gap between the inner and the outer shell in a gyratory crusher. Upon a calibration, a crushing head, on which the inner shell is mounted, is moved vertically upward until the inner shell comes into contact with the outer shell. This contact, which is used as a reference upon setting of the width of the gap between the inner and the outer shell, occurs at a point where the gap is most slender. In order to avoid the possibility that cast remainders or other protruding objects can affect the calibration, cast shells are subjected to a machining before they are used. This machining means that the part of the shell that can be expected to contact an opposite shell during the calibration, is made even.

It is a problem upon fine crushing of hard material by means of a gyratory crusher that a great share of the crushed material has a larger size than what was intended. For this reason, a great part of the crushed material has to be crushed one more time for achievement of the desired size.

SUMMARY OF THE INVENTION

It is an object of the present invention to provide a shell for use upon fine crushing in a gyratory crusher, which shell decreases or entirely eliminates the problems of the known technique.

This object is provided by means of a shell, which is of the kind mentioned by way of introduction and is characterized in that the first crushing surface has a vertical height that extends upward from the outlet of the crushing gap along the first crushing surface to the inlet of the crushing gap, the first crushing surface over at least 50% of said vertical height, from the outlet and upward along the first crushing surface, having been machined to a run-out tolerance, which on each level along the machined part of the vertical height of the first crushing surface is maximum one thousandth of the largest diameter of the first crushing surface, however maximum 0.5 mm.

It has turned out that by means of a shell of this type, the material that is supplied to a crusher, in which the shell has been mounted, can be crushed to considerably smaller sizes. This entails an increased efficiency in the crushing since less energy is consumed for the achievement of a certain quantity of crushed material having a certain size. The mechanical load on the crusher will also become considerable less. For the achievement of this increased efficiency, at least 50% of the vertical height of the crushing surface according to the above has to be machined to small run-out tolerance. Namely, it has turned out that the compression of the material that is to be crushed gives rise to a pressure, which is very great up to said level on the crushing surface. Therefore, a larger run-out in the crushing surface somewhere along said 50% of the vertical height of the crushing surface would entail a substantially increased mechanical load and that the material cannot be crushed to equally small sizes. Upon machining of, for instance, only 10% of the height of the crushing surface, i.e., only in the area of the shortest distance between the inner and the outer shell, it is true that it is possible to set an exact gap between the shells but no increase of efficiency is obtained. The interesting measure in the invention is the run-out tolerance, which is to be viewed as a measure of roundness in combination with centring. A crushing surface that has high roundness but is not centred will not entail any increased efficiency. The machined part of the crushing surface has to be machined to a very small run-out tolerance in order to provide the increased efficiency and the decreased mechanical load. Thus, the run-out must not anywhere along the machined part of the crushing surface exceed 0.5 mm.

According to a preferred embodiment, said run-out tolerance is maximum 0.35 mm. Closed Side Setting (CSS) is the shortest distance between the inner shell and the outer shell and is the shortest distance between the inner and the outer shell that arises during the gyrating motion, more precisely when the inner shell "closes" against the outer shell. A very small run-out tolerance is especially advantageous when very small shortest distances (CSS) between the inner and the outer shell are utilized, for instance, when the shortest distance is approx. 4 to 8 mm. A very small run-out tolerance, such as maximum 0.35 mm, makes it possible to provide a more slender gap than what previously has been possible without the mechanical load during the crushing becoming too great. Even more preferred, the run-out tolerance should be maximum 0.5 thousandths of the largest diameter of the first crushing surface, however maximum 0.25 mm.

Preferably, the first crushing surface has been machined to said run-out tolerance over at least 75% of the vertical height thereof from the outlet. This entails the advantage that in particular shells intended for crushing of fine material, for instance crushing of stones having an initial size of 5–30 mm, can be utilized efficiently and without too great mechanical load on the crusher. Thus, it is possible to hold a small shortest distance (CSS) between the inner and the outer shell and thereby provide a crushing to small sizes. At such a small shortest distance between the shells, the compression, and thereby the pressure, will become great also up to a level of approx. 75% of the vertical height of the crushing surfaces from the outlet, but the same means, thanks to the run-out tolerance being small up to at least the same level, no problem. Even more preferred is that the first crushing surface has been machined to the run-out tolerance over substantially the entire vertical height thereof. With such a crushing surface, which has been machined to small run-out tolerance over up to 100% of the vertical height thereof, the shell becomes robust to supplied material and can be used both for crushing of fine-grained material at a very small shortest distance (CSS), such as 3–6 mm, but also for crushing of a somewhat larger material at a larger shortest distance (CSS), such as 6–20 mm.

Another object of the present invention is to provide an efficient method of manufacturing a shell for use upon fine crushing in a gyratory crusher, which shell decreases or entirely eliminates the problems of the known technique.

This object is provided by a method, which is of the above-mentioned kind and is characterized in that first-mentioned shell is produced by a shell work piece being manufactured and provided with the first crushing surface, which is given a vertical height that extends upward from the outlet of the crushing gap along the first crushing surface to the inlet of the crushing gap, the first crushing surface over at least 50% of said vertical height, from the outlet and upward along the first crushing surface, being provided with a machining allowance, that a surface on the shell work piece is machined in order to form said support surface, and that said first crushing surface along said at least 50% of said vertical height is machined to a run-out tolerance that on each level along the machined part of the vertical height of the first crushing surface is maximum one thousandth of the largest diameter of the first crushing surface, however maximum 0.5 mm. An advantage of the machining allowance is that material can be removed from the entire crushing surface upon the machining, also at such portions where the manufacture, for instance casting with subsequent heat treatment, has given rise to geometrical deformations.

According to a preferred embodiment, the first crushing surface is machined by being turned. Turning is an efficient machining method for achievement of a small run-out tolerance. The fact that the shell is rotated during the machining substantially facilitates the possibility of achieving a very small run-out tolerance. An additional advantage is that a certain strain hardening of the crushing surface is provided upon turning. A common material in crushing shells is manganese steel, which has the property that it is strain hardening. Thereby, upon the turning of a shell of manganese steel, a certain increase of hardness is provided in the crushing surface, which may be an advantage in cases when the shell should be used for crushing of material, which is wearing but not particularly hard and therefore cannot generate a strain hardening fast in the crushing surface.

Preferably, in the manufacture of the shell work piece, substantially the entire first crushing surface is provided with a machining allowance of at least 2 mm, substantially the entire first crushing surface being machined to said run-out tolerance of the first crushing surface. According to an even more preferred embodiment, the machining allowance should be 2–8 mm. The machining allowance has to be at least so large that no geometrical deformations remain in the machined part of the crushing surface after machining to a small run-out tolerance. A machining allowance of at least 2 mm, more preferred at least 3 mm, means that conventional casting can be utilized in the production of a shell work piece. The machining allowance should not be larger than approx. 8 mm, even more preferred approx. 6 mm, since this means increased material and machining costs.

It is also an object of the present invention to provide a gyratory crusher for use upon fine crushing, which gyratory crusher is more efficient than the known crushers.

This object is provided by a gyratory crusher, which is of the above-mentioned kind and is characterized in that the first crushing surface has a vertical height that extends upward from the outlet of the crushing gap along the first crushing surface to the inlet of the crushing gap, the first crushing surface over at least 50% of said vertical height, from the outlet and upward along the first crushing surface, having been machined to a run-out tolerance, which on each level along the machined part of the vertical height of the first crushing surface is maximum one thousandth of the largest diameter of the first crushing surface, however maximum 0.5 mm. A gyratory crusher of this type will enable crushing at very small shortest distances (CSS) between the shells, which ensures an efficient crushing to small sizes.

According to a preferred embodiment, the first shell is an inner shell and the second shell an outer shell, the second crushing surface having a second vertical height that extends upward from the outlet along the second crushing surface to the inlet, the second crushing surface over at least 50% of said second vertical height, from the outlet and upward along the second crushing surface, having been machined to a run-out tolerance, which on each level along the machined part of the second vertical height of the second crushing surface is maximum one thousandth of the largest diameter of the second crushing surface, however maximum 0.5 mm. When both the inner and the outer shell has a crushing surface which along at least 50% of the respective vertical height thereof has been machined to a small run-out tolerance, the crusher will be able to operate at very small shortest distances (CSS) between the inner and the outer shell and thereby provide a large size reduction of the supplied material.

According to an even more preferred embodiment, the sum of the run-out tolerances of the first crushing surface and the second crushing surface on each level along mutually opposite portions of the machined parts of the crushing surfaces is maximum 0.7 mm. This sum of run-out tolerances, which accordingly is calculated as the sum of the run-out tolerance of the first crushing surface and the run-out tolerance of the second crushing surface on each level on the mutually opposite portions where the two crushing surfaces are machined to small run-out tolerances, will ensure a considerably lower mechanical load from fatigue point of view. An additional advantage is that the crushing surface that is most easy to machine, e.g. the crushing surface of the inner shell, can be machined to a very small run-out tolerance, e.g. maximum 0.2 mm, the second crushing surface, e.g. the crushing surface of the outer shell, can be machined to a relatively seen larger run-out tolerance, e.g. maximum 0.4 mm.

Preferably, the respective crushing surfaces of the first and the second shell have a largest diameter of at least 500 mm. It is only at larger sizes on the inner and the outer shell that said run-out tolerance gives the increased efficiency in the form of increased quantity of crushed material and/or smaller size on the crushed material and better grain shape on the crushed material and that the decreased mechanical load on the crusher may lead to a significant increase of the service life of the crusher.

BRIEF DESCRIPTION OF THE DRAWINGS

The invention will henceforth be described by means of embodiment examples and with reference to the appended drawings.

DESCRIPTION OF PREFERRED EMBODIMENTS

Figure 1:
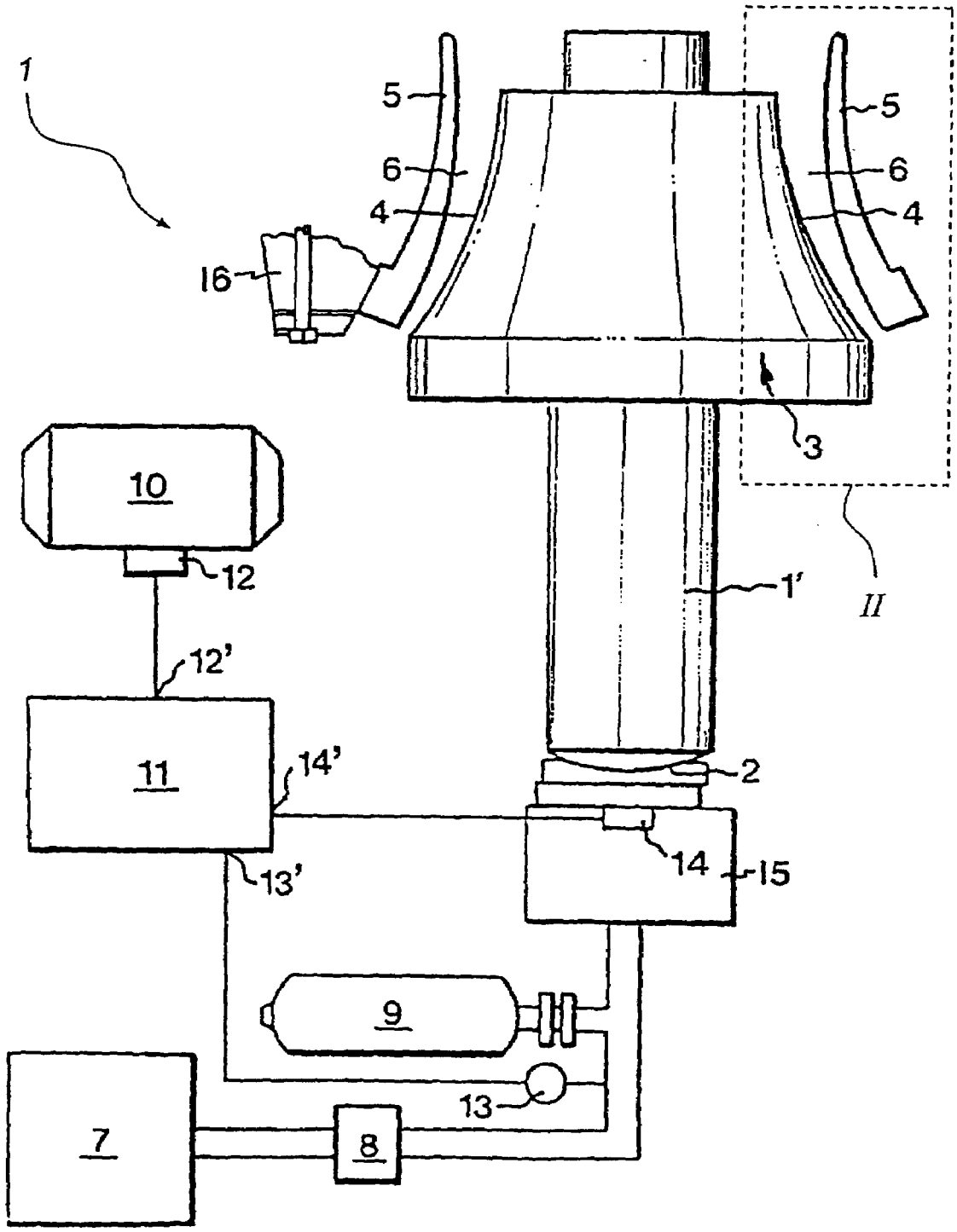
FIG. 1 schematically shows a gyratory crusher having associated driving, setting and control devices.

In FIG. 1, a gyratory crusher 1 is schematically shown, which is of the type production crusher for fine crushing and is intended for the greatest feasible production of crushed material of a certain desired size. With fine crushing, here it is meant that the crusher is intended to crush material that has an original size of less than 100 mm to a size of less than 20 mm. By production crusher, here is meant a crusher that is intended to produce more than approx. 10 tons/hour (t/h) of crushed material and that the crushing surfaces of the crusher, described below, have a largest diameter that is larger than 500 mm. The crusher 1 has a shaft 1', which at the lower end 2 thereof is eccentrically mounted. At the upper end thereof, the shaft 1' carries a crushing head 3. A first, inner, crushing shell 4 is mounted on the outside of the crushing head 3. In a machine frame 16, a second, outer, crushing shell 5 has been mounted in such a way that it surrounds the inner crushing shell 4. Between the inner crushing shell 4 and the outer crushing shell 5, a crushing gap 6 is formed, which in axial section, as is shown in FIG. 1, has a decreasing width in the downward direction. The shaft 1', and thereby the crushing head 3 and the inner crushing shell 4, is vertically movable by means of a hydraulic setting device, which comprises a tank 7 for hydraulic fluid, a hydraulic pump 8, a gas-filled container 9 and a hydraulic piston 15. Furthermore, a motor 10 is connected to the crusher, which motor is arranged to bring the shaft 1' and thereby the crushing head 3 to execute a gyratory motion during operation, i.e., a motion during which the two crushing shells 4, 5 approach each other along a rotary generatrix and retreat from each other at a diametrically opposite generatrix.

In operation, the crusher is controlled by a control device 11, which: (a) via an input 12' receives input signals from a transducer 12 arranged at the motor 10, which transducer measures the load on the motor, (b) via an input 13' receives input signals from a pressure transducer 13, which measures the pressure in the hydraulic fluid in the setting device 7, 8, 9, 15, and (c) via an input 14' receives signals from a level transducer 14, which measures the position of the shaft 1' in the vertical direction in relation to the machine frame 16. The control device 11 comprises, among other things, a data processor, whereby the device 11 controls, on the basis of received input signals, among other things, the hydraulic fluid pressure in the setting device 7, 8, 9, 15.

When the crusher 1 is to be calibrated, the supply of material is interrupted. The motor 10 continues to be in operation and brings the crushing head 3 to execute the gyratory pendulum motion. Next, the pump 8 increases the hydraulic fluid pressure so that the shaft 1', and thereby the inner shell 4, is raised until the inner crushing shell 4 contacts the outer crushing shell 5. When the inner shell 4 contacts the outer shell 5, a pressure increase arises in the hydraulic fluid, which is recorded by the pressure transducer 13. The vertical position of the inner shell 4 is registered by the level transducer 14 and this position corresponds to a most slender width of 0 mm of the gap 6. Knowing the gap angle between the inner crushing shell 4 and the outer crushing shell 5, the width of the gap 6 can be calculated at any position of the shaft 1' as measured by the level transducer 14.

When the calibration is finished, a suitable width of the gap 6 is set and the supply of material to the crushing gap 6 of the crusher 1 is commenced. The supplied material is crushed in the gap 6 and can then be collected vertically below the same.

Figure 2:
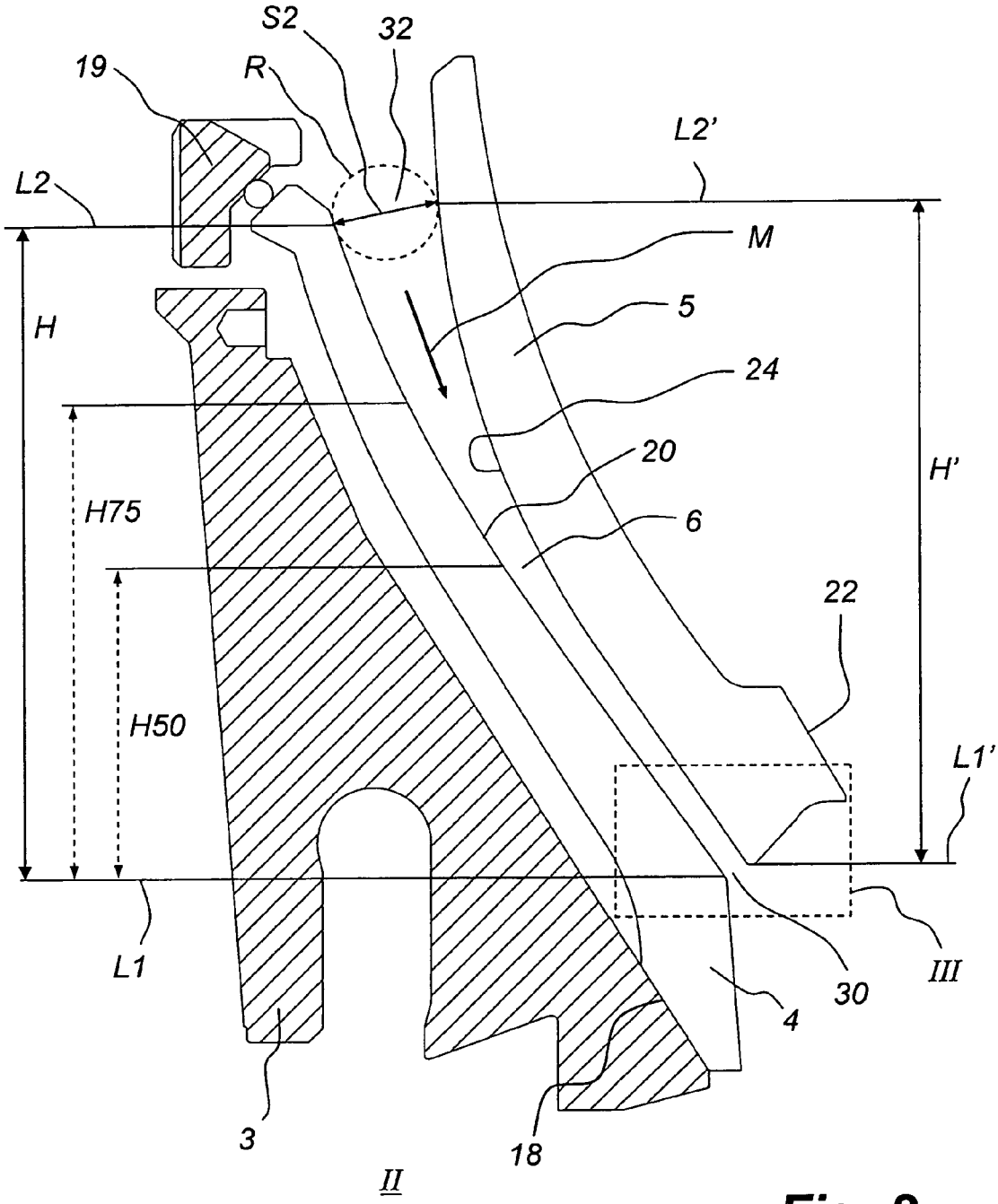
FIG. 2 is a cross-section and shows the area II shown in FIG. 1 in enlargement.

FIG. 2 shows the inner crushing shell 4, which is carried by the crushing head 3 and is locked on the same by a nut 19, schematically shown in FIG. 2. A machined support surface 18 on the inner crushing shell 4 abuts against the crushing head 3. The inner shell 4 has a first crushing surface 20 against which supplied material is intended to be crushed. The outer crushing shell 5 has a support surface 22, which abuts against the machine frame, not shown in FIG. 2, and a second crushing surface 24. The supplied material, in FIG. 2 symbolized by a substantially spherical stone block R, will accordingly move downward in the direction M while it is crushed between the first crushing surface 20 and the second crushing surface 24 to decreasingly smaller sizes.

Figure 3:
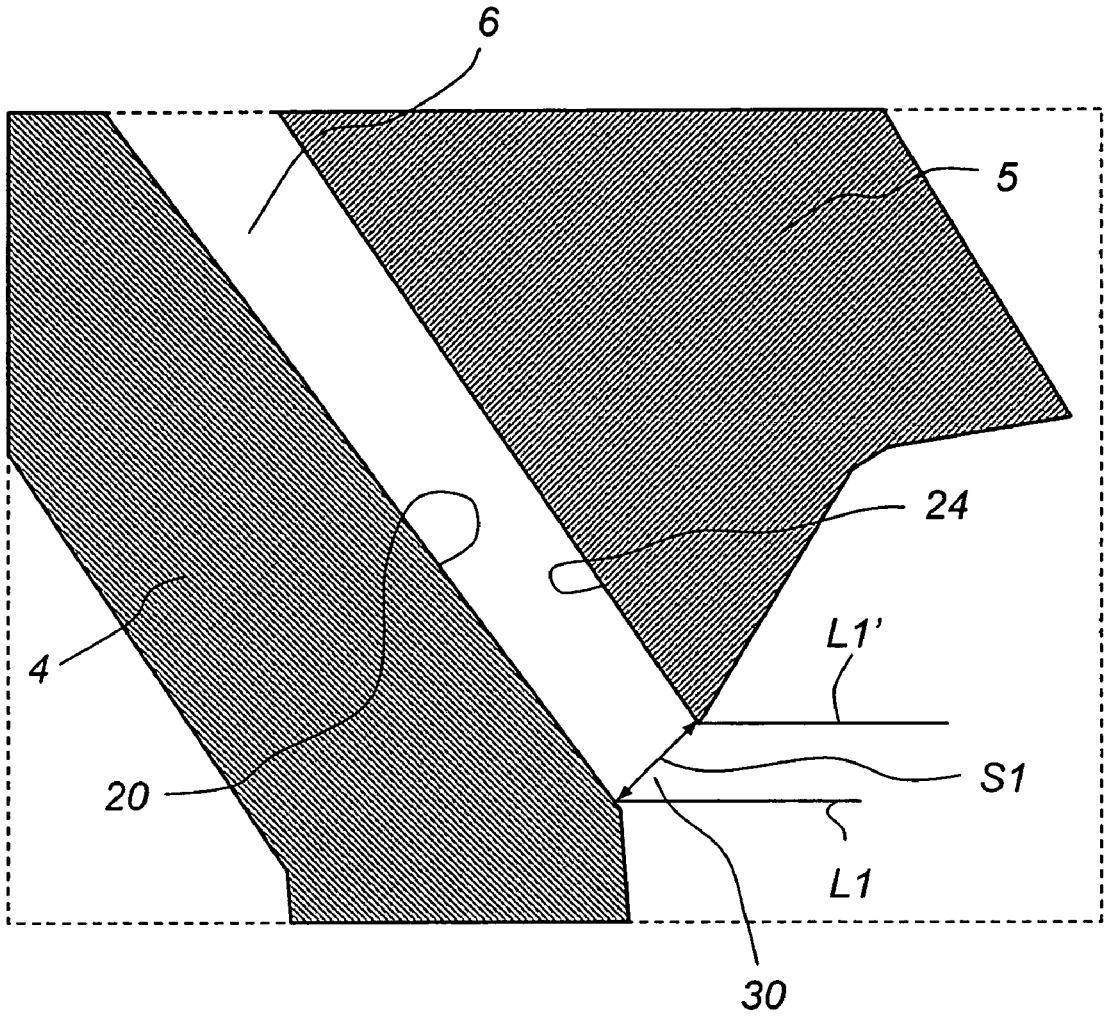
FIG. 3 is a cross-section and shows the area III shown in FIG. 2 in enlargement.

FIG. 3 shows the shortest distance S1 between the inner crushing shell 4 and the outer crushing shell 5. The distance S1 usually exists farthest down in the crusher 1, i.e., where the crushed material just is about to leave the crushing gap 6 via an outlet 30. After the material has passed out through the outlet 30, generally no additional crushing of the material takes place before it leaves the crusher 1. The distance S1, which frequently is called CSS (closed side setting), decides the size of the crushed material leaving the crusher 1. As has been mentioned above, the shaft 1' executes a gyrating motion and thereby the distance at a given point between the inner shell 4 and the outer shell 5 will vary during the motion of the shaft 1'. The distance S1, and CSS, relates to the absolutely shortest distance between the shells, i.e., when the inner shell 4 "closes" against the outer shell 5. The crushing surface 20 of the inner shell 4 has a vertical height H (see also FIG. 2) that extends from the outlet 30, which corresponds to a level L1 on the inner shell 4, at which level the distance to the outer shell 5 usually is shortest, i.e., where the distance S1 usually is at hand, to the inlet 32 of the crushing gap 6. The inlet 32 is the position where supplied material begins to be exposed to crushing between the inner shell 4 and the outer shell 5. The inlet 32 corresponds to a level L2 on the inner shell 4 where a distance S2 to the outer shell 5 usually corresponds to the size of the largest object which is to be crushed in the crusher 1 at the shortest distance S1 in question, i.e., the distance S2 is substantially equal to the diameter of the object R shown in FIG. 2. The crushing surface 24 of the outer shell 5 has a vertical height H' (see also FIG. 2) that extends from the outlet 30, which corresponds to a level L1' on the outer shell 5, at which level the distance to the inner shell 4 usually is shortest, i.e., where the distance S1 is at hand, to the inlet 32, which corresponds to a level L2' on the outer shell 5 where usually the above-mentioned distance S2 is at hand, i.e., where the distance to the inner shell 4 is substantially equal to the diameter of the object R shown in FIG. 2.

The inner shell 4 and the outer shell 5 that are shown in FIGS. 1–3 are so-called M shells that are intended for crushing stone blocks R having an original size of typically approx. 50–100 mm to a size of typically approx. 10–20 mm. Upon such crushing, a shortest distance S1, i.e., CSS, of approx. 10–20 mm is used. The crushing surface 20 of the inner shell 4 has along the entire vertical height H thereof been turned to a run-out tolerance that is less than 0.5 mm. Also, the crushing surface 24 of the outer shell 5 has been machined to a run-out tolerance of less than 0.5 mm over the entire vertical height H' thereof.

Figure 4:
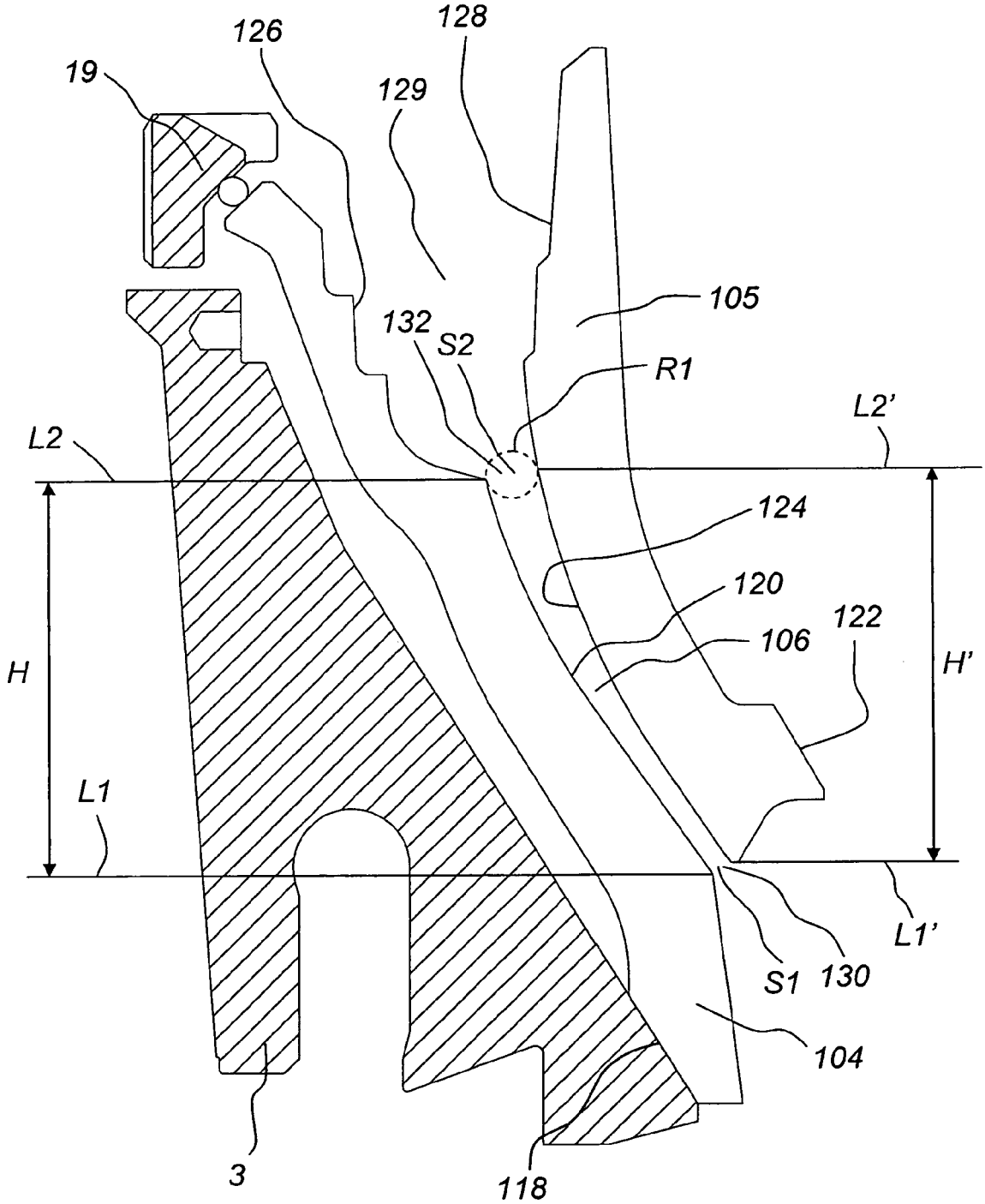
FIG. 4 is a cross-section and shows a second embodiment of the invention.

FIG. 4 shows an alternative embodiment of the present invention. In FIG. 4, an inner shell 104 and an outer shell 105 are shown, which are of the so-called EF type, which means that they are intended for extreme fine crushing. The inner shell 104 has a support surface 118, which abuts against the crushing head 3 and a crushing surface 120. The crushing surface 120 has a vertical height H, which extends upward from an outlet 130 of a crushing gap 106, which corresponds to a level L1, which usually is situated at the shortest distance S1 between the inner shell 104 and the outer shell 105, to the inlet 132 of the crushing gap 106, which corresponds to a level L2, which usually is situated where the distance S2 to the outer shell 105 substantially corresponds to the size of a largest object R1 that is to be crushed. In analogy with what has been described above, the outer shell 105 has a support surface 122 and a crushing surface 124. The crushing surface 124 has a vertical height H', which extends upward from the outlet 130 to the inlet 132, i.e., from the level L1' to the level L2'. Thus, between the crushing surfaces 120, 124, the proper crushing gap 106 is formed, where crushing of supplied stone blocks R1 is carried out. As is clearly seen in FIG. 4, the inner shell 104 has a portion 126 that is located above the level L2 and the outer shell 105 has a portion 128 that is located above the level L2'. Between said portions 126, 128 an antechamber 129 is formed that serves as store of material that awaits being dosed into between the crushing surfaces 120, 124. No proper crushing takes place in the chamber 129 and the portions 126, 128 do therefore not constitute any part of the crushing surfaces 120, 124, which end on the respective level L2, L2', i.e., at the inlet 132.

It may be convenient to machine the shell 105 to a small run-out tolerance also a distance above the level L2'. The reason is that the level for the inlet 132 after a time of operation will be moved upward on the shell 105 since the shells 104, 105 then have become worn and the shell 104 as a consequence of this has had to be moved upward for retention of a constant, smallest distance S1.

The shells 104, 105 shown in FIG. 4 are intended for crushing small objects, i.e., objects R1 that have an original size of typically approx. 10–50 mm to a size of typically approx. 0–12 mm. Upon such crushing, a shortest distance S1, i.e., CSS, of approx. 2–10 mm is used. The crushing surface 120 of the inner shell 104 has along the entire vertical height H thereof been turned to a run-out tolerance that is maximum 0.35. Also, the crushing surface 124 of the outer shell 105 has over the entire vertical height H' thereof been machined to a run-out tolerance of maximum 0.35 mm.

The manufacture of shells 4, 5, 104, 105, proceeds in the following way.

In a first step, a shell work piece is manufactured, for instance by casting in a sand mould. The first step resembles the already known ways to manufacture shell work pieces by, for instance, casting, with the essential difference that the shell work piece is manufactured having a machining allowance of approx. 3–6 mm all over the portion of the shell work piece that in the finished shell should constitute the crushing surface. Also the part of the shell work piece that in the finished shell should constitute the support surface is provided with a machining allowance. After cooling, the shell work piece is taken out of the mould and is heat-treated.

Figure 5:
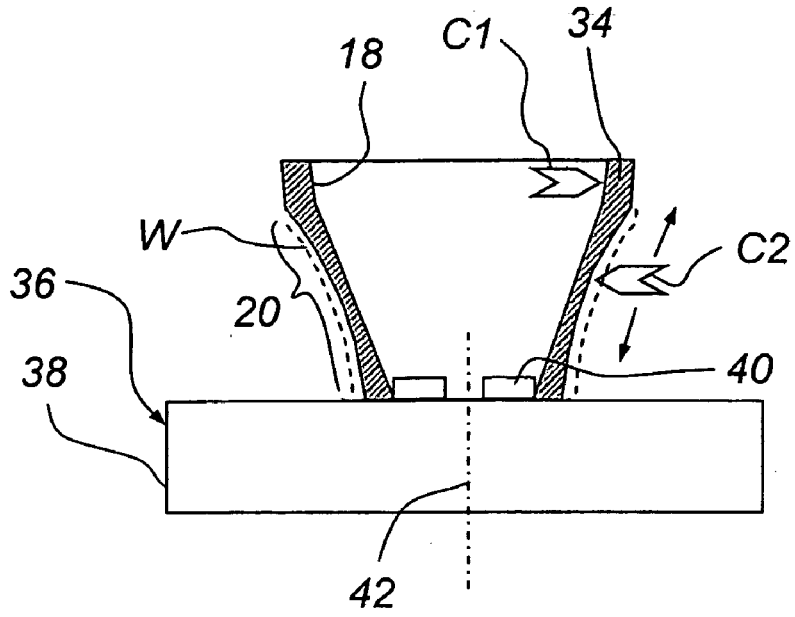
FIG. 5 is a cross-section and shows a device for the manufacture of shells according to the present invention.

In a second step, the thus-formed shell work piece 34 is fastened, as is seen in FIG. 5, in a vertical boring mill 36. The vertical boring mill 36 has a rotary plate 38 and a number of clamping jaws 40 by means of which the position of the shell work piece 34 on the plate 38 can be set in such a way that the centre line of the shell work piece 34 generally coincides with the centre line 42 of the plate 38. The plate 38 is then caused to rotate the shell work piece 34. A turning tool C1 is utilized in order to machine a support surface 18 on the inside of the shell work piece 34. The machining is made in such a way that the support surface 18 gets a small tolerance in respect of roundness. Thanks to the fact that the shell work piece 34 is rotated during the machining, the support surface 18 will furthermore become centred around the centre axis of the shell work piece and thereby obtain a small run-out tolerance.

In a third step, a turning tool C2 is utilized in order to machine a crushing surface 20 in the shell work piece 34 while the same is rotated in the vertical boring mill 36. The third step is commenced directly after the machining of the support surface 18 without the shell work piece 34 first having been released from the plate 38. Thanks to the fact that the shell work piece 34 is rotated during the machining, it becomes relatively easy to machine a crushing surface 20 having a small run-out tolerance. As is indicated by arrows at the turning tool C2, the entire crushing surface 20 is machined to said run-out tolerance by the machining allowance, symbolized by W, being worked away. By means of this method of production, the crushing surface 20 will obtain a small run-out tolerance in relation to the support surface 18. When the finished shell 4 is placed on a crushing head 3, the crushing surface 20 will, thanks to the fact that it has a small run-out tolerance in relation to the support surface 18, obtain a small run-out tolerance also in the mounted state.

It will be appreciated that it is also possible to reverse the second and third steps, i.e., in a second step, to machine the crushing surface 20, and in a third step, without the shell work piece 34 first being released from the plate 38, machine the support surface 18. Alternatively, it is also possible to work up both the crushing surface 20 and the support surface 18 simultaneously in the same working step. In all cases, it applies that the crushing surface 20 and the support surface 18 both are machined to low run-out tolerance and furthermore to have a common centre line.

It will be appreciated that an outer shell can be produced in a similar way as has been described above, reference having been made to an inner shell.

Figure 6:
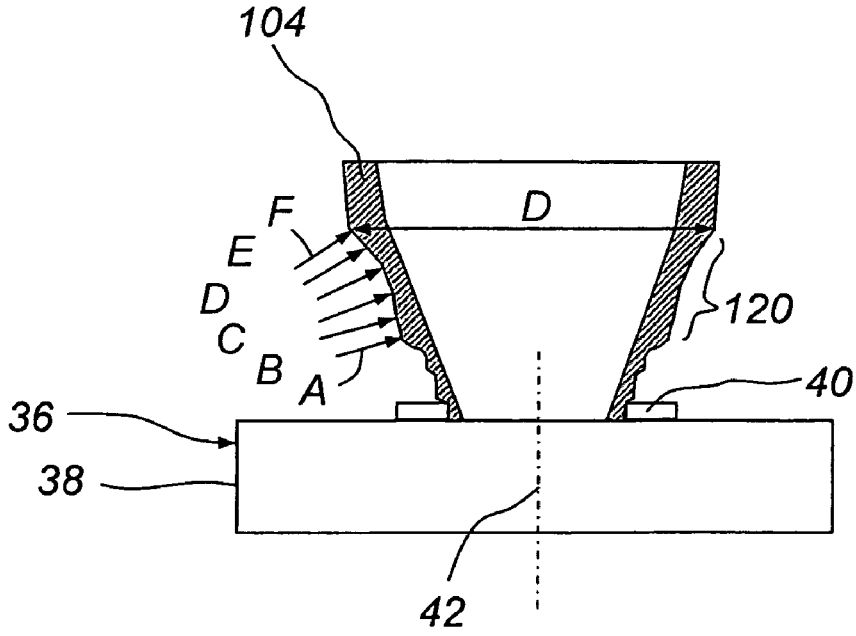
FIG. 6 is a cross-section and shows measurement of the run-out on a crushing surface.

After completion of the machining thereof, the shell is then checked in respect of run-out tolerance. In FIG. 6, it is shown how such a control can be carried out according to the Swedish Standard SS 2650, method 20.1.6 (Run-out in conical surface) by means of a so-called dial test indicator. As is seen in FIG. 6, a shell 104, i.e., the type of shell that is described in connection with FIG. 4, has been mounted on the plate 38 of the vertical boring mill 36. It will be appreciated that a check of the run-out tolerance conveniently can be carried out directly after the crushing surface 120 has been worked up but before the shell 104 has been dismounted from the plate 38. A possible resetting of the run-out tolerance can be carried out in direct conjunction with the check. The run-out tolerance over at least 50% of the height of the crushing surface, counted from the outlet 130 and upward, should be maximum one thousandth of the largest diameter D of the crushing surface 120, as is seen in FIG. 6, however maximum 0.5 mm in absolute numbers.

It will be appreciated that a number of modifications of the above-described embodiments are feasible within the scope of the present invention.

Thus, it is also possible to machine only a part of the crushing surface to a small run-out tolerance. However, at least 50% of the vertical height of the crushing surface, counted from the outlet 30, i.e., from the first level L1, L1', has to be machined to this run-out tolerance. This is exemplified in FIG. 2 by a vertical height H50, which describes the height of the smallest area of the crushing surface 20 that has to be machined to a small run-out tolerance. Preferably, at least 75% of the vertical height of the crushing surface, from the outlet 30, i.e., from the first level L1, L1', should be machined to a small run-out tolerance, which in FIG. 2 is exemplified by a vertical height H75. In all cases, it applies that the run-out tolerance within the entire machined area, which accordingly is the area that lies within the height H50 or a greater height, e.g. H75 or H, should be machined in such a way that the run-out tolerance on a arbitrary level within this area meets the established requirements.

The above-described machining of the crushing surface to a small run-out tolerance may also be carried out in other ways than turning. For instance, the surface may be ground. Turning is, however, preferred since it is a relatively easy way to provide a small run-out tolerance.

In the description above, a crusher is described that has a hydraulic setting of the vertical position of the inner shell. It will be appreciated that the invention also can be applied to, among other things, crushers that have a mechanical setting of the gap between the inner and the outer shell, for instance, the type of crushers that is disclosed in Symons U.S. Pat. No. 1,894,601. In the last-mentioned type of crushers, occasionally called Symons type, the setting of the gap between the inner and the outer shell is carried out by the fact that a case, in which the outer shell is fastened, is threaded in a machine frame and is turned in relation to the same for the achievement of the desired gap. These crushers are frequently even more sensible to mechanical load than the above-described crushers having hydraulic setting device and may therefore derive great advantage from the present invention.

In the description above it is described that each shell 4, 5 has one support surface 18, 22 each. The invention may also be applied to a shell that has two or more support surfaces.

In the description above it is mentioned that the shortest distance S1 (CSS) between the inner shell 4 and the outer shell 5 usually exists at the outlet 30 of the crushing gap 6, i.e., at the level L1 and L1', respectively. However, there is also a case where the shortest distance S1 exists a bit above the outlet 30, i.e., above the level L1 and L1', respectively. In such cases, it is frequently convenient to machine the respective crushing surface 20, 24 from the outlet 30, i.e., from the level L1 and L1', respectively, and upward to at least 75% of the respective crushing surface's 20, 24 vertical height from the outlet 30.

The present invention may be applied to all sizes of crushers. The invention is especially advantageous in production crushers, which are crushers the shells of which have crushing surfaces having a largest diameter D of 500 mm and larger, which crushers are intended for a rate of production of approx. 10 tons/hour of crushed material or more during continuous operation. The invention is particularly advantageous in production crushers intended for fine crushing, i.e., when objects having an initial size of approx. 100 mm or smaller is to be crushed to a size of approx. 20 mm or smaller. In particular upon crushing of material to a size of approx. 10 mm or smaller and when the shortest distance S1 (CSS) between the inner and the outer shell is approx. 15 mm or shorter, the present invention will ensure a considerable energy-saving and reduced mechanical load in comparison with the known technique.

EXAMPLES

In order to illustrate the advantages of the present invention, two tests were carried out. In test 1 an outer shell and an inner shell were used, the crushing surfaces of which had been machined to a small run-out tolerance according to the invention. In test 2, an inner shell and an outer shell according to prior art were used.

Test 1

The test was carried out with a gyratory crusher of the type H3800, which is marketed by Sandvik SRP AB, Svedala, SE. A shell work piece of the type EF, i.e., the type of shell 104 that is shown in FIG. 4, was machined in a lathe to a small run-out tolerance all over the crushing surface 120. The crushing surface 120 of the inner shell 104 had a largest diameter D of 950 mm, which diameter was located at the level L1. After turning, the run-out of the shell 104 was measured by means of a dial test indicator. In one way, which corresponds to the way indicated in FIG. 6, the measurement of run-out was made perpendicularly to the respective surface on six levels A to F, which levels were evenly distributed along the vertical height H of the crushing surface 120, in relation to the support surface 118, which constituted a reference. The level F substantially corresponded to the outlet 130, i.e., the level L1, and the level A substantially corresponded to the inlet 132, i.e., the level L2. On each level A–F, the run-out was measured in eight turning positions, i.e., in eight points or sectors (in table 1 below denominated sectors 1–8), evenly distributed around the circumference of the level in question. Thus, the sector 1 in each level served as a reference point, so the position of the dial test indicator is represented as "0" in table 1 below. As the indicator progressed from sector no. 1 to the next sector no. 2 around the circumference of a respective level, if the diameter of the crushing surface did not change, then the indicator would not move and a "0" reading would result. However, if the diameter changed, then the indicator would be moved in or out from the reference position, depending on whether the diameter increased or decreased. In one direction of movement of the indicator, the measured distance of movement would be given a positive value (+), and in the opposite direction of movement, it would be given a negative value (−). The largest difference between the measured deviations of the eight sectors at a given level would constitute the largest run-out for that level. Thus, if the largest positive deviation were +4, and the largest negative deviation on the same level were −6, then the largest run-out for that level would be 4−(−6)=10. In table 1, the measured run-out of the inner shell is seen in hundredths of mm:

TABLE 1

Measured absolute values of run-outs at inner shell according to the invention [in units of 1/100 mm]

| | | Sector | | | | | | | |
|---|---|---|---|---|---|---|---|---|---|
| | | 1 | 2 | 3 | 4 | 5 | 6 | 7 | 8 |
| Level | A | 0 | <1 | <1 | <1 | <1 | <1 | <1 | <1 |
| | B | 0 | <1 | <1 | <1 | <1 | <1 | <1 | <1 |
| | C | 0 | <1 | <1 | <1 | <1 | <1 | <1 | <1 |
| | D | 0 | <1 | <1 | <1 | <1 | <1 | <1 | <1 |
| | E | 0 | <1 | <1 | <1 | <1 | <1 | <1 | <1 |
| | F | 0 | <1 | <1 | <1 | <1 | <1 | <1 | <1 |

By <1 is meant that the run-out is greater than −0.01 mm and less than +0.01 mm. Accordingly, the highest possible run-out at any level is the difference between the maximum and minimum possible values, i.e., 0.01−(−0.01)=0.02 mm. Thus, on each level the crushing surface 120 has a run-out tolerance that is better than 0.5 mm. Hence, the ratio of the largest run-out to the largest diameter of the shell was 0.02 mm/950 mm×1000=0.021 thousandths, i.e., the largest run-out was smaller than 0.021 thousandths of the largest diameter D of the crushing surface 120.

An outer shell, which was of the type of the outer shell 105 (called EF) shown in FIG. 4, was machined in a vertical boring mill. After the machining, which was carried out all over the crushing surface 124, the run-out on the corresponding levels A to F (where the level F substantially corresponded to the outlet 130 and the level A substantially corresponded to the inlet 132) was measured in eight sectors per level in analogy with what has been described above for the inner shell. Table 2 shows the measured run-outs for the outer shell 105:

TABLE 2

Measured run-out at outer shell according to the invention [1/100 mm]

| | | Sector | | | | | | | |
|---|---|---|---|---|---|---|---|---|---|
| | | 1 | 2 | 3 | 4 | 5 | 6 | 7 | 8 |
| Level | A | 0 | −19 | −30 | −22 | −8 | 15 | 23 | 21 |
| | B | 0 | −19 | −30 | −21 | −9 | 11 | 18 | 17 |
| | C | 0 | 12 | −19 | −12 | −5 | 5 | 9 | 10 |

TABLE 2-continued

Measured run-out at outer shell according to the invention [1/100 mm]

| | Sector | | | | | | | |
|---|---|---|---|---|---|---|---|---|
| | 1 | 2 | 3 | 4 | 5 | 6 | 7 | 8 |
| D | 0 | −6 | −10 | −6 | −5 | −2 | −3 | 2 |
| E | 0 | −7 | −7 | −5 | −5 | −9 | −9 | −4 |
| F | 0 | −8 | −4 | −5 | −4 | −14 | −12 | −9 |

As is seen in table 2, the largest run-out, i.e., the largest difference between the measured values on a certain level, was 0.53 mm (i.e., 23−(−30)/100 mm), more precisely on a level A, i.e., at the inlet 132. The first 50% of the vertical height H' of the crushing surface 124, counted from the outlet 130, i.e., the level L1', and upward corresponds to the levels F to D in table 2. The largest run-out within said levels F to D is 0−(−14)/100 mm=0.14 mm, more precisely on a level F. Thus, on each level along 50% of the vertical height H' of the crushing surface 124, counted upward from the outlet 130, the outer shell 105 has a run-out tolerance which is better than 0.5 mm. The crushing surface 124 of the outer shell 105 had a largest diameter of 1000 mm, which diameter was at hand at the level L1'. The ratio of the largest run-out along 50% of the vertical height H' of the crushing surface 124, counted from the outlet 130, to the largest diameter of the shell was 0.14 mm/1000 mm×1000=0.14 thousandths, i.e., the largest run-out was 0.14 thousandths of the largest diameter D of the crushing surface 124. Hence, the sum of the run-out of the first crushing surface 120 and the run-out of the second crushing surface 124 was not on any level, along the first 50% of the respective crushing surface's vertical height H and H', respectively, from the outlet 130, larger than 0.02 mm+0.14 mm=0.16 mm.

The inner and the outer shell 104, 105 were then mounted in a crusher, which beforehand had been adjusted so that the machine frame 16 as well as the crushing head 3 had a run-out tolerance that was smaller than 0.05 mm.

Figure 7:
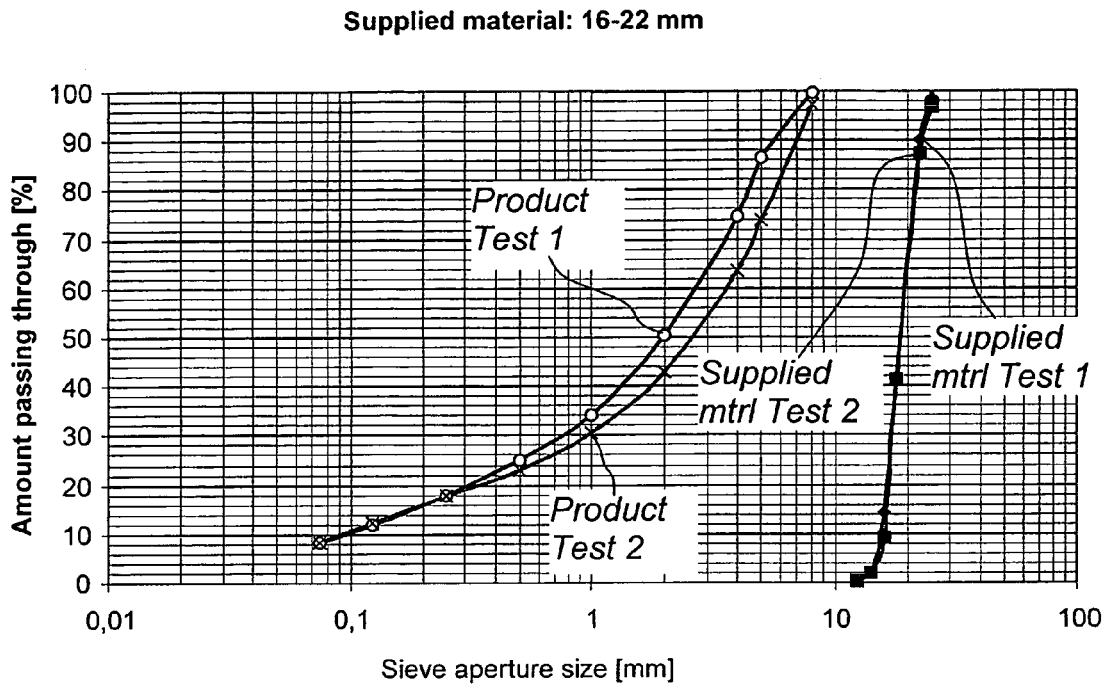
FIG. 7 is a graph and shows size distribution of supplied material and crushed product in two tests.
Figure 8:
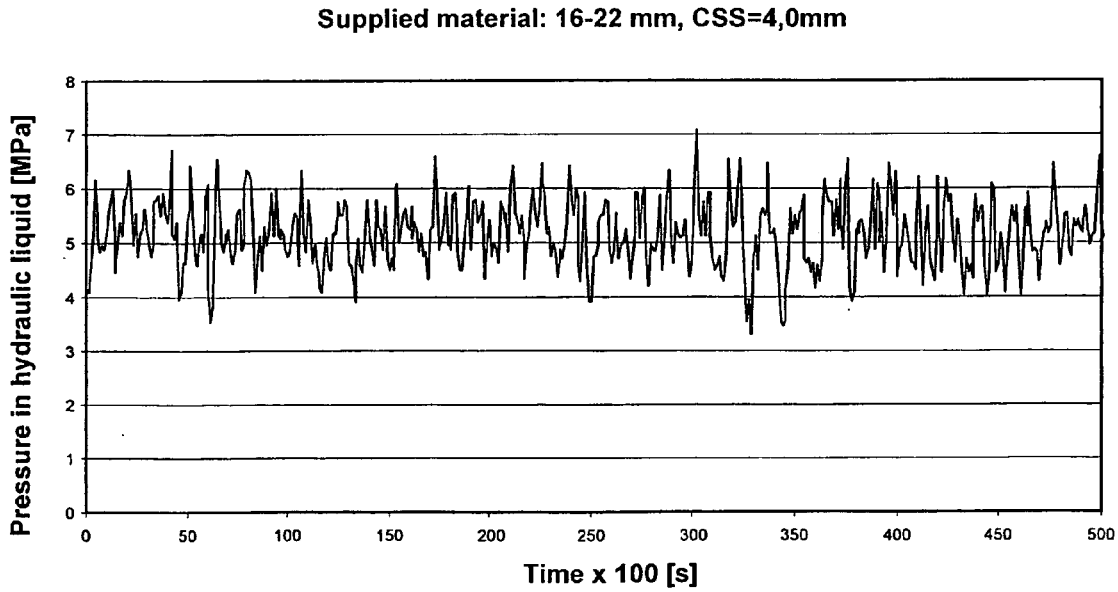
FIG. 8 is a graph and shows variations of pressure in a test of crushing.

In test 1, a material called "16–22 mm" was introduced in the crusher. The grain size distribution in the supplied material as well as in the crushed product of test 1 is seen in FIG. 7, which shows the amounts of the supplied material and of the product passing through a sieve as a function of the sieve aperture size. The crusher was set to operate at an average pressure in the hydraulic fluid in the setting device of the crusher of approx. 5 MPa. Upon the crushing, between the inner and the outer shell a shortest distance S1, i.e., CSS, of 4.0 mm was held. The crusher consumed a power of approx. 135 kW. The total amount of material that was crushed was 48 t/h. Of the crushed product, 74.6% by weight had a size that was smaller than 4 mm, accordingly the production of material having a size smaller than 4 mm being 48 t/h×74.6% by weight=35.8 Vh. The grain shape of the crushed material was evaluated by means of a so-called LT index. LT designates that the ratio of the length of a grain to the width thereof is smaller than 3. Thus, the LT index states the weight share of grain having a ratio of length to thickness that is smaller than 3. Normally, LT index should be as high as possible, since it means that the material has a high cubicity, which is desirable in most crushing applications. The crushed material in test 1 had an LT index of 93% by weight in the fraction 5–8 mm. FIG. 8 shows the pressure variation in the hydraulic fluid as a function of time.

The average pressure in the hydraulic fluid of the setting device was approx. 5.19 MPa and the standard deviation was 0.61 MPa.

Test 2

With the purpose of comparing the invention with prior art, a test 2 was carried out in which an inner and an outer shell according to prior art were mounted in the crusher used in test 1. The shells were of the type EF, i.e., they were of the same type as those that were used in test 1. The shells that were used in test 2 were, however, of known type and thereby not machined to a small run-out tolerance. Before the test was started, the run-out of the inner shell and the outer shell was measured by means of the above-described method. The run-out of the inner shell according to prior art is seen in table 3.

TABLE 3

Measured run-out at inner shell according to prior art [1/100 mm]

| | | Sector | | | | | | | |
|---|---|---|---|---|---|---|---|---|---|
| | | 1 | 2 | 3 | 4 | 5 | 6 | 7 | 8 |
| Level | A | 0 | 38 | −11 | −13 | 14 | 13 | −13 | 56 |
| | B | 0 | 72 | −46 | −113 | 1 | 66 | −4 | 9 |
| | C | 0 | 28 | −68 | −172 | −55 | 3 | −65 | 34 |
| | D | 0 | −13 | −115 | −175 | −128 | −79 | −70 | −18 |
| | E | 0 | −12 | −27 | −54 | −78 | −82 | −50 | −18 |
| | F | 0 | −12 | −28 | −65 | −82 | −88 | −52 | −19 |

As is seen in table 3, the largest run-out of the crushing surface, i.e., the largest difference between the measured values on a certain level, was 2.06 mm (i.e., 34−(−172)/100 mm), more precisely on level C. The largest run-out along 50% of the vertical height of the crushing surface, counted from the outlet of the crushing gap and upward, was 1.75 mm, more precisely on level D.

The run-out of the outer shell according to prior art is seen in table 4.

TABLE 4

Measured run-out at outer shell according to prior art [1/100 mm]

| | | Sector | | | | | | | |
|---|---|---|---|---|---|---|---|---|---|
| | | 1 | 2 | 3 | 4 | 5 | 6 | 7 | 8 |
| Level | A | 0 | −110 | −194 | −194 | −360 | −193 | −23 | 23 |
| | B | 0 | −99 | −176 | −176 | −314 | −197 | −11 | 14 |
| | C | 0 | −23 | −72 | −172 | −238 | −133 | 48 | 14 |
| | D | 0 | −1 | −21 | −104 | −205 | −103 | 21 | 2 |
| | E | 0 | −20 | −45 | −82 | −90 | −102 | −109 | −53 |
| | F | 0 | −33 | −54 | −99 | −91 | −120 | −125 | −68 |

As is seen in table 4, the largest run-out, i.e., the largest difference between the measured values on a certain level, was 3.83 mm (i.e., 23−(−360)/100 mm), more precisely on level A, i.e., at the inlet of the crushing gap. The largest run-out along 50% of the vertical height of the crushing surface, counted from the outlet of the crushing gap and upward, was 2.26 mm, more precisely on level D.

Figure 9:
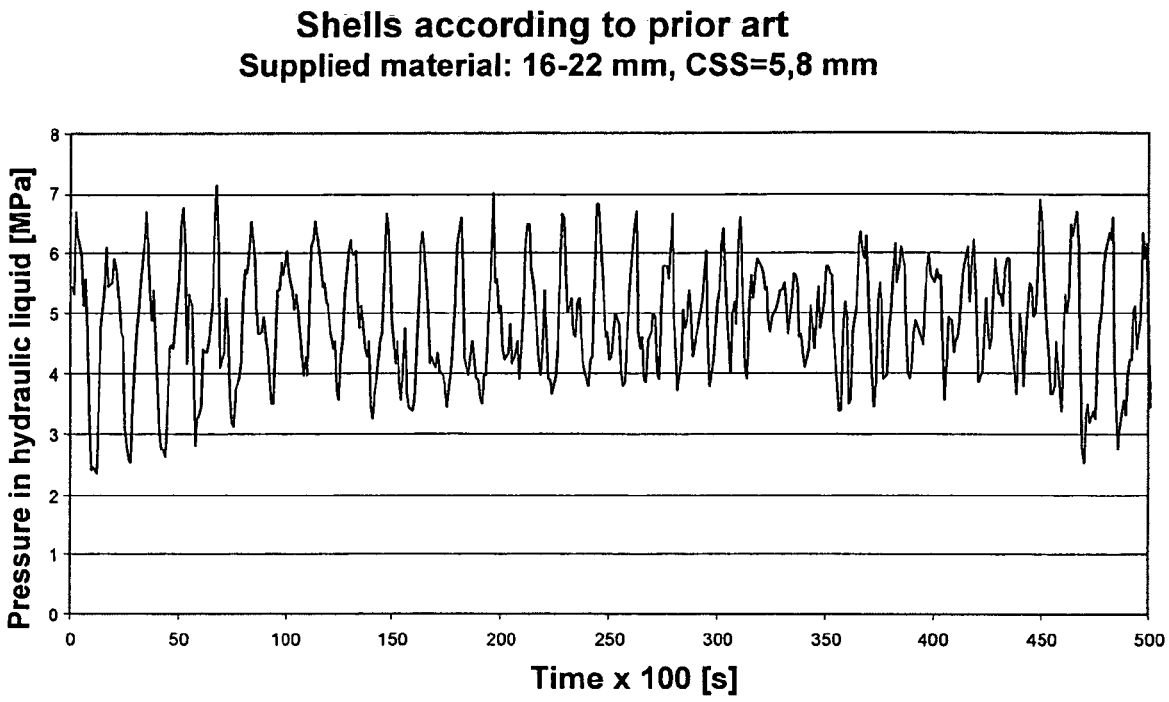
FIG. 9 is a graph and shows variations of pressure in a comparative test of crushing.

In test 2, a material called "16–22 mm" was introduced in the crusher. The grain size distribution in the supplied material as well as in the crushed product of test 2 are seen in FIG. 7. As is seen in FIG. 7, the supplied material had almost identical grain size distribution in test 1 and test 2. The crusher was set to operate at an average pressure in the hydraulic fluid in the setting device of the crusher of approx. 5 MPa. Upon the crushing, a shortest distance S1 was held between the inner and the outer shell, i.e., CSS, of 5.8 mm. The crusher consumed a power of approx. 150 kW. The amount of material that was crushed was 57 t/h. Of the crushed product, 63.4% by weight had a size that was smaller than 4 mm, accordingly the production of material having a size smaller than 4 mm being 57 t/h×63.4% by weight=36.1 t/h. The crushed material in test 2 had an LT index of 85% by weight in the fraction 5–8 mm. FIG. 9 shows the pressure variation in the hydraulic fluid as a function of time. The average pressure was approx. 4.87 MPa and the standard deviation of the same average pressure was 0.92 MPa.

As is seen in the above, approximately equally much, approx. 36 t/h, crushed material was produced having a size that was smaller than 4 mm in test 1 and test 2. However, in test 1 the crusher consumed only 135 kW versus approx. 150 kW in test 2. In test 1, only 48 t/h was fed into the crusher while 57 t/h was fed into the crusher in test 2. This means that also auxiliary equipment, such as conveyors etc., consumed more energy in test 2. The reason for the higher flow of material in test 2 was that a great share of the material that was fed to the crusher was not crushed to the desired size but had to be recirculated for an additional crushing. The greater flow of material in test 2, which accordingly was due to the inferior crushing and the greater recirculation following thereby, entails an increased wear on the crusher and the shells according to prior art in comparison with the invention. As is also seen in FIG. 7, the crusher in test 1 could crush the material to smaller sizes than in test 2. The produced material had also a considerably better grain shape (i.e., LT index) in test 1 than in test 2. The considerably lower variation in hydraulic fluid pressure in test 1 (standard deviation 0.61 MPa, see also FIG. 8) than in test 2 (standard deviation 0.92 MPa, see also FIG. 9) means a considerably lower mechanical load on the crusher generally and the hydraulic setting device in particular.

Although the present invention has been described in connection with preferred embodiments thereof, it will be appreciated by those skilled in the art that additions, modifications, substitutions, and deletions may be made without departing from the spirit and scope of the invention as defined in the appended claims.

What is claimed is:

1. A shell for use in a gyratory crusher, the shell including at least one support surface and a crushing surface, the crushing surface defining a largest diameter and having an inlet and an outlet, the inlet disposed above the outlet, the crushing surface having a vertical height extending from the outlet to the inlet, the crushing surface being machined to a run-out tolerance along at least 50% of the vertical height from the outlet upwards, wherein the run-out tolerance around a circumference of the machined crushing surface does not exceed one-thousandth of the largest diameter, or 0.5 mm, whichever is less.

2. The shell according to claim 1 wherein the maximum value does not exceed 0.35 mm.

3. The shell according to claim 2 wherein the crushing surface is machined to the run-out tolerance along at least 75% of the vertical height.

4. The shell according to claim 1 wherein the crushing surface is machined to the run-out tolerance along substantially the entire vertical height.

5. A gyratory crusher comprising: a first shell-carrying member; a first shell having at least one support surface abutting against the first shell-carrying member, and a first crushing surface; a second shell having at least one support surface abutting against the second shell-carrying member, and a second crushing surface; the first and second crushing surfaces opposing one another and defining therebetween a gap in which material is to be crushed, the gap having an inlet and an outlet, the inlet disposed above the outlet, the first crushing surface defining a largest diameter and having a vertical height extending from the outlet to the inlet, the first crushing surface being machined to a run-out tolerance along at least 50% of the vertical height from the outlet upwards, wherein the run-out tolerance around a circumference of the machined crushing surface does not exceed one-thousandth of the largest diameter, or 0.5 mm, whichever is less.

6. The gyratory crusher according to claim 5, wherein the first shell comprises an inner shell and the second shell comprises an outer shell, the second crushing surface defining a largest diameter and having a vertical height extending from the outlet to the inlet, the second crushing surface being machined to a run-out tolerance along at least 50% of the vertical height of the second crushing surface from the outlet upwards, wherein the run-out tolerance around a circumference of the machined second crushing surface does not exceed one-thousandth of the largest diameter of the second crushing surface, or 0.5 mm, whichever is less.

7. The gyratory crusher according to claim 6 wherein a sum of the run-out tolerances of opposing portions of the first and second crushing surfaces is no greater than 0.7 mm.

8. The gyratory crusher according to claim 5 wherein the largest diameter of each of the first and second crushing surfaces is at least 500 mm.

* * * * *